US008366101B2

(12) United States Patent
Morita

(10) Patent No.: US 8,366,101 B2
(45) Date of Patent: Feb. 5, 2013

(54) PAPER FEEDER WITH A PAIR OF BLOWING UNITS

(75) Inventor: Yoshihisa Morita, Tokyo (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 13/137,510

(22) Filed: Aug. 23, 2011

(65) Prior Publication Data

US 2012/0056367 A1 Mar. 8, 2012

(30) Foreign Application Priority Data

Aug. 25, 2010 (JP) ..... 2010-188530

(51) Int. Cl.
*B65H 7/02* (2006.01)

(52) U.S. Cl. ..... 271/227; 271/97; 271/105; 271/226

(58) Field of Classification Search ..... 271/3.02, 271/3.11, 5, 97, 105, 109, 121, 226, 227, 271/261, 262, 263
See application file for complete search history.

(56) References Cited

U.S. PATENT DOCUMENTS

2004/0178557 A1* 9/2004 Okazaki et al. ..... 271/97
2009/0127768 A1* 5/2009 Shima et al. ..... 271/97
2010/0129127 A1* 5/2010 Suzuki ..... 399/388

FOREIGN PATENT DOCUMENTS

JP H11-349165 A 12/1999
JP 2005-314094 A 11/2005

* cited by examiner

*Primary Examiner* — Jeremy R Severson
(74) *Attorney, Agent, or Firm* — Manabu Kanesaka

(57) ABSTRACT

This paper feeder brings the uppermost paper sheet of a plurality of stacked paper sheets into contact with paper feed rollers and feeds out the paper sheet in a paper feeding direction by the drive thereof. Side fences for guiding both side edges of the paper sheet on a paper feeding table are provided with a pair of blowing units for blowing air to both side edges of the paper sheet, whose air quantity can be controlled independently of each other. When skewing occurs, the blowing units are controlled to blow a larger quantity of air to the paper side edge having larger friction against a lower paper sheet as compared with the quantity of air to the other paper side edge. In paper feeding, problems such as skewing, multi-feeding and idle feeding can be addressed.

3 Claims, 14 Drawing Sheets

| | AIR QUANTITY | | DIRECTION | |
|---|---|---|---|---|
| FAN F | 5 LEVELS | 5 (max) | 3 WAYS | FORWARD |
| | | 4 | | TRANSVERSE |
| | | 3 | | BACKWARD |
| | | 2 | | |
| | | 1 (min) | | |
| FAN R | 5 LEVELS | 5 (max) | 3 WAYS | FORWARD |
| | | 4 | | TRANSVERSE |
| | | 3 | | BACKWARD |
| | | 2 | | |
| | | 1 (min) | | |

F I G. 10

| | FAN F | | FAN R | | NOTES |
|---|---|---|---|---|---|
| | AIR QUANTITY | AIR DIRECTION | AIR QUANTITY | AIR DIRECTION | |
| MULTI-FEED | +2 | - | +2 | - | |
| IDLE FEED | +2 | - | +2 | - | |
| SKEW (SLIGHT) | | | | | |
| 0<F-R<PREDETERMINED VALUE | -1 | - | +1 | - | ※DETECT F EARLIER |
| 0<R-F<PREDETERMINED VALUE | +1 | - | -1 | - | ※DETECT R EARLIER |
| SKEW (SERIOUS) | | | | | |
| F-R>PREDETERMINED VALUE | -2 | - | +2 | - | |
| | - | BACKWARD | - | FORWARD | ※CONTROL ONLY BY ROTATION |
| R-F>PREDETERMINED VALUE | +2 | - | -2 | - | |
| | - | FORWARD | - | BACKWARD | ※CONTROL ONLY BY ROTATION |

F I G. 11

| | FAN F | | FAN R | | NOTES |
|---|---|---|---|---|---|
| | AIR QUANTITY | AIR DIRECTION | AIR QUANTITY | AIR DIRECTION | |
| LIGHTWEIGHT PAPER | +2 | - | +2 | - | |
| HEAVY PAPER | - | - | - | - | |

PAPER FEEDER WITH A PAIR OF BLOWING UNITS

RELATED APPLICATIONS

The present application is based on, and claims priority from Japanese Application No. 2010-188530, filed Aug. 25, 2010, the disclosure of which is hereby incorporated by reference herein in its entirety.

BACKGROUND

1. Technical Field

This invention relates to a paper feeder, which is provided as a paper feeding mechanism of an image forming apparatus, for example, and sequentially feeds a number of stacked paper sheets from the top using a paper feed roller, and particularly to the paper feeder, which may surely feed paper sheets one by one without skewing, idle feeding and multi-feeding regardless of the kind of a paper sheet.

2. Description of the Related Art

As a paper feeder for supplying a paper sheet to an image forming apparatus or the like, for example, a known paper feeder is configured so that a number of paper sheets are loaded on a table, the upper most paper sheet is brought into contact with a paper feed roller from below, and the paper sheets are sequentially fed out from the top paper sheet first by the drive of the paper feed roller. In this type of paper feeder, as the height of stacked paper sheets is decreased with feeding out of the paper sheets, the table is elevated to keep the contact between the uppermost paper sheet and the paper feed roller. The paper feeders disclosed in the respective patent literatures described in the following show examples of this type of paper feeder.

JP-A No. 2005-314094 discloses a paper feeder, which efficiently blows out the air to a recording paper sheet with pressure loss of the air held down to thereby simply separate the closely contacting recording paper sheets from each other. In this paper feeder, the position in the right-angled direction to the feeding direction of the recording paper sheet P does not overlap a retard roll 72, and a duct 90 is disposed to overlap the retard roll 72 when viewed in the right-angled direction to the feeding direction of the recording paper sheet P. Thus, the air generated by a blower 94 is blown out to the edge part in the feeding direction of the recording paper sheet P, and the recording paper sheets P fed out from a paper feed tray 44 by a nudger roll 68 are separated by the retard roll 72. The retard roll 72 does not constitute an obstacle so that the duct 90 can be shaped to decrease pressure loss. Therefore, the air enough to release the close contact of the recording paper sheets P is blown out from the duct 90 without using a blower 94 and a fan having a large capacity.

JP-A No. H11-349165 discloses a paper feeder, in which an air current is controlled by an air blowing unit according to the kind of a paper sheet to surely feed paper sheets one by one. This paper feeder includes a paper feed tray 10 on which sheets 23 are piled, a paper feeding unit 2 for feeding the sheets 23 piled on the paper feed tray 10, a push-up unit for pushing up the sheets 23 piled on the paper feed tray 10 by the paper feeding unit 2 towards the height at which the sheets are fed out, a blowing port 21 opened to blow an air current to the side of the sheets 23 pushed up by the push-up unit, a blowing unit 20 for blowing a continuous air current from the blowing port 21, and a blowing position setting unit for setting the air blowing position according to the kind of the sheet 23.

Although the paper feeders described in JP-A Nos. 2005-314094 and H11-349165 are common in that paper sheets in a stack are separated from each other by an air blow and fed out, it is impossible to adjust the quantity of supplied air depending on place such as the right and the left of a paper sheet. Therefore, it is impossible to supply the air quantity adjusted at every required position of the paper sheet according to the state of the loaded paper sheets, resulting in the problem that troubles in paper feeding such as skewing, multi-feeding and idle feeding cannot always be addressed.

This invention has been made in the light of the above circumstances to accurately address the problems in paper feeding such as skewing, multi-feeding and idle feeding by adjusting the quantity of air supplied for every place such as the right and the left of a paper sheet to supply the quantity of air suitable for a required position of the paper sheet according to the state of loaded paper sheets.

SUMMARY OF INVENTION

According to one aspect of the invention, a paper feeder includes: a paper feed table on which paper sheets are stacked; a paper feed roller, which is provided at a predetermined position above the paper feed table and driven in contact with an upper surface of the uppermost paper sheet of paper sheets stacked on the paper feed table to feed the uppermost paper sheet in a paper feeding direction; and a pair of blowing units, which are provided along a paper width direction, and controlled independently of each other to blow air below the uppermost paper sheet.

According to a second aspect of the invention, the paper feeder in accordance with the one aspect further includes: a pair of paper detecting units, which are provided on a downstream side in the paper feeding direction with respect to the paper feed roller to respectively detect both end parts in the paper width direction of the paper sheet fed out in the paper feeding direction, wherein the pair of blowing units is controlled to be different in air quantity based on a difference in paper detection timing between the pair of paper detecting units.

According to a third aspect of the invention, the paper feeder in accordance with the one aspect further includes: a pair of paper detecting units, which are provided on the downstream side in the paper feeding direction with respect to the paper feed roller to respectively detect both end parts in the paper width direction of the paper sheet fed out in the paper feeding direction, wherein the pair of blowing units is controlled to be different in air direction based on a difference in paper detection timing between the pair of paper detecting units to correct skewing of the fed-out paper sheet.

According to a fourth aspect of the invention, the paper feeder in accordance with the first aspect or the second aspect includes: a transmission type paper detecting unit provided on the downstream side of the paper feed roller as the paper detecting unit, wherein an air quantity of the pair of blowing units is increased based on a light receiving quantity of the transmission type paper detecting unit to control at least one of paper multi-feeding and idle feeding to be corrected.

In the paper feeder in accordance with the one aspect, when the paper sheet is fed out in the paper feeding direction by the paper feed roller, although the paper sheets are often skewed, multi-fed or idle-fed due to the mutual close contact state of paper sheets or the other causes, the blowing units that make a pair disposed along the paper width direction are controlled independently of each other according to the paper feeding status of the paper sheets so that the paper feeding state can be improved to perform normal paper feeding.

In the paper feeder in accordance with the second aspect, the paper detecting units that make a pair are disposed on the downstream side of the paper feed roller. The paper detecting units are capable of respectively detecting both end parts in the paper width direction of the paper sheet fed out in the paper feeding direction, so skewing of the paper sheet is found from a difference in detection timing. Then, the blowing units that make a pair are controlled to be different in air quantity based on a difference in paper detection timing between the paper detecting units, thereby correcting skewing of the fed-out paper sheet most suitably according to the degree.

In the paper feeder in accordance with the third aspect, the paper detecting units that make a pair are disposed on the downstream side of the paper feed roller. The paper detecting units are capable of respectively detecting both end parts in the paper width direction of the paper sheet fed out in the paper feeding direction, so skewing of the paper sheet is found from a difference in detecting timing. Then, the blowing units that make a pair are controlled to be different in air direction based on a difference in paper detecting timing between the paper detecting units that make a pair, and a force in the rotating direction is exerted on the paper sheet, thereby correcting skewing of the fed-out paper sheet most suitably according to the degree.

In the paper feeder according to the fourth aspect, the transmission type paper detecting unit, which is decreased in light receiving quantity when a paper sheet passes, is disposed as the paper detecting unit on the downstream side of the paper feed roller. Therefore, when the light receiving quantity of the transmission type paper detecting unit, which is obtained as an output signal of the transmission type paper detecting unit in paper feeding, decreases as compared with that in the normal case, multi-feeding in which paper sheets are fed in a multi-layer is determined. On the other hand, when the light receiving quantity of the transmission type paper detecting unit does not decrease at all, idle feeding in which no paper sheet is fed is determined. Therefore, when the air quantity of the blowing units that make a pair is increased based on the output of the transmission type paper detecting units, multi-feeding of paper sheets and idle feeding can be corrected most suitably according to the degree.

BRIEF DESCRIPTION OF THE DRAWINGS

FIG. 10 is a table showing the adjustment range of air quantity and air direction of the blowing unit in the embodiment of the invention;

FIG. 11 is a table showing settings of air quantity of the blowing unit corresponding to the paper sheet information in the embodiment of the invention;

DETAILED DESCRIPTION OF PREFERRED EMBODIMENT

According to the present embodiment, a paper feeder 1 improves paper feeding failure such as multi-feeding by blowing the air to loaded paper sheets by a blowing unit 2 capable of freely adjusting the air direction and the air quantity, and the following description deals with the general configuration, the adjustment and settings for the air quantity and the air direction of the blowing unit 2; the occurrence of error and correction method in the operating state, and the whole control procedure by each heading.

1. General Configuration (FIG. 1 to FIG. 8)

The paper feeder 1 in accordance with the embodiment is provided as a paper supply unit in an apparatus for processing a supplied paper sheet for a predetermined purpose, for example, an image forming apparatus such as a printing apparatus, which is adapted to form an image on a supplied paper sheet.

Figure 1:
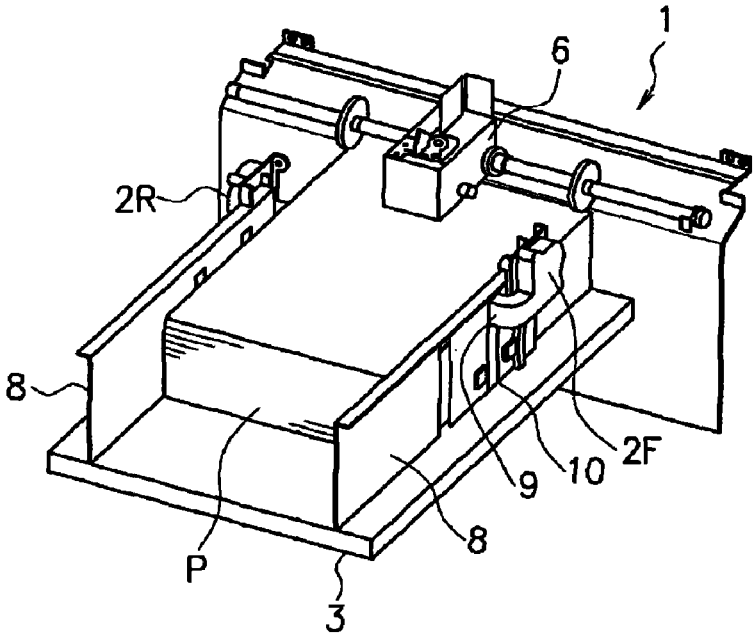
FIG. 1 is a general perspective view of a paper feeder according to an embodiment of the invention.
Figure 2:
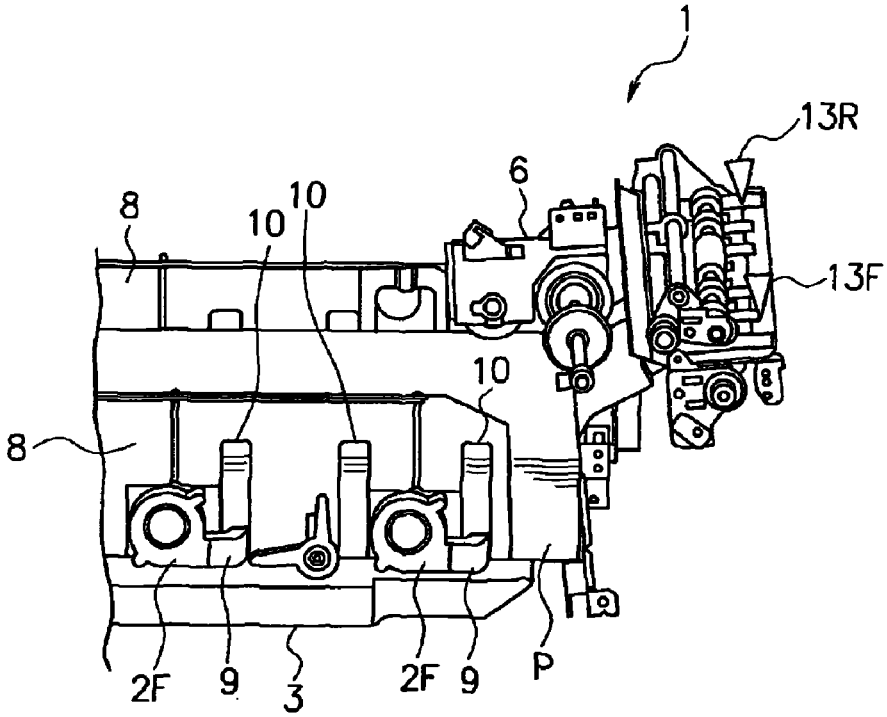
FIG. 2 is a diagram showing the arrangement position of paper detecting units in the embodiment of the invention.

As shown in FIG. 1 to FIG. 2, the paper feeder 1 includes a paper feed table 3 for loading paper sheets P. The paper feed table 3 is capable of freely elevating between a lower limit position, which is a replenishing position for paper sheets P, and an upper limit position, which is a paper feed position for an image forming apparatus, by a publicly known elevating mechanism and an elevating motor not shown, which are provided on the body side.

Figure 3:
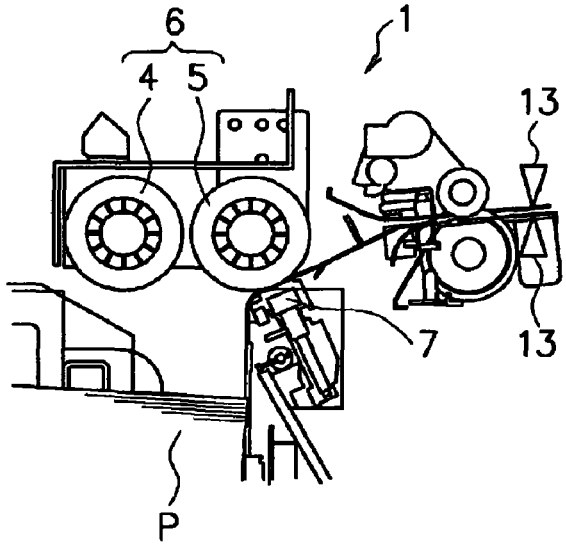
FIG. 3 is a diagram showing the arrangement position of paper detecting units in the embodiment of the invention.

As shown in FIG. 1 to FIG. 3, a paper feeding unit 6 including first and second paper feed rollers 4, 5 is mounted at a predetermined position above the upper limit position of the paper feed table 3 on the body side, and the paper feed rollers 4, 5 are driven by a driving motor not shown. That is, the first paper feed roller 4 feeds out the paper sheets P on the elevating paper feed table 3 to the body, the paper sheets P are handled by a handling member 7 (shown in FIG. 3) fitted to the body and the second paper feed roller 5 to be fed one by one into an image forming part not shown on the body side.

As shown in FIG. 1 and FIG. 2, a pair of side fences 8, 8 for guiding a pair of side edges of paper sheets P loaded on the paper feed table 3 are provided on the upper surface of the paper feed table 3. The pair of side fences 8, 8 are disposed on the upper surface of the paper feed table 3 to be parallel to the paper feeding direction of the paper sheet P. Not shown in the drawing, when a user applies a force in the width direction of the paper sheet P (the direction orthogonal to the paper feeding direction in a horizontal plane) to the side fence 8, the side fences 8, 8 interlock with each other to move in the width direction of the paper sheet P in a mode of being symmetrical about the center line of the paper sheet P parallel to the paper feeding direction as a reference, so that the side fences 8, 8 can be set at a desired space between them with reference to the center line. Thus, the space between the side fences 8 can be set optionally according to the width of the paper sheets P placed on the paper feed table 3.

As shown in FIG. 1, at the same position on the outer surface side of each side fence 8, a blowing unit 2 for separating paper sheets, which blows the air to the side edges of the paper sheets P, is provided to separate the uppermost paper sheet P from the other paper sheets P of the paper sheets P placed on the paper feed table 3. As the blowing unit 2, a fan may be taken, in which a propeller is driven in rotation by a driving unit such as a motor to blow the air, or the blowing units using the other principles may be taken.

A blow-out port of each blowing unit 2 is connected and communicated with a hole formed at the same position of each side fence 8 through a duct 9. Therefore, the blowing units 2, 2 are respectively capable of blowing the air currents in the air direction orthogonal to the side fences 8, 8 and opposite to each other toward the insides of the side fences 8, 8. Although FIG. 1 shows the condition where the side fences 8, 8 are provided with the blowing units 2, 2, as a modified form shown in FIG. 2, each side fence 8 is provided with two blowing units 2, so that the pair of side fences 8 may be provided with two pairs of blowing units 2.

Figure 4:
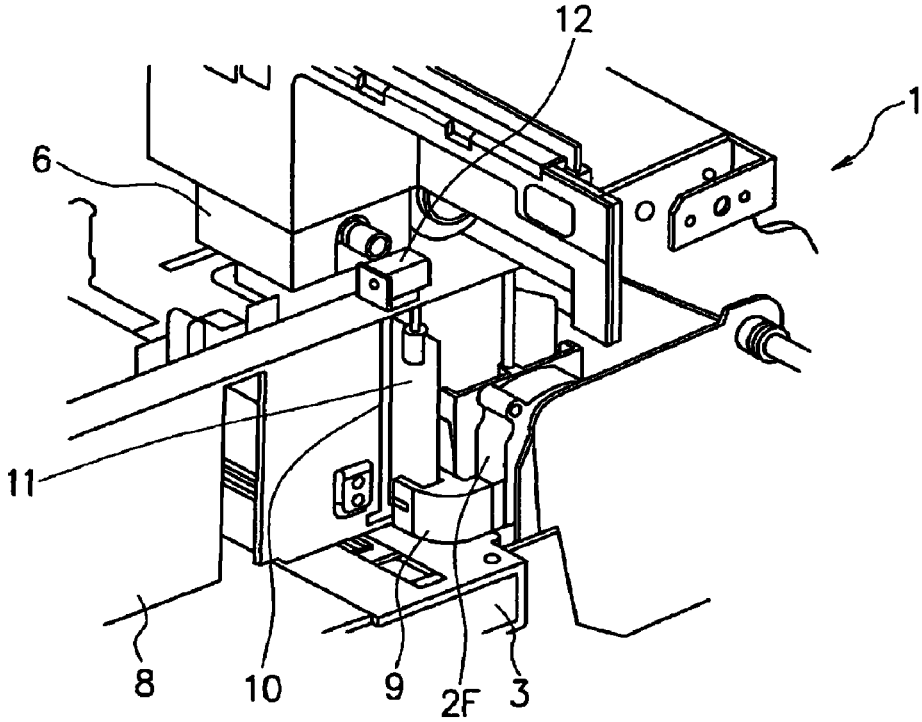
FIG. 4 is a perspective view showing an air direction control device of a blowing unit in the embodiment of the invention.

Not being shown in details in FIG. 1, as shown in detail in FIG. 4, an air direction control plate 11 for adjusting the air direction of the blowing unit 2 (the direction of an air current from the blowing unit 2) is rotatably provided between an outlet of the duct 9 connected to the blow-out of the blowing unit 2 and the hole 10 of the side fence 8. The air direction control plate 11 is an oblong rectangular plate member having a vertical shaft in the central part, and the upper end of the shaft is connected to a driving shaft of a control motor 12 fitted to the side fence 8. The air direction control plate 11 is rotated by driving the control motor 12, thereby changing the direction of an air current blown out from the outlet of the duct 9 through the hole 10 of the side fence 8 toward the inside of the side fence 8.

Figure 5:
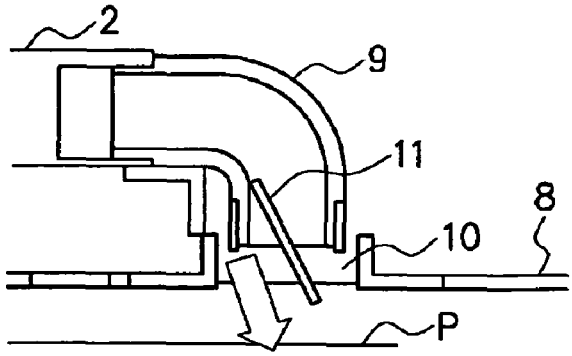
FIG. 5 is a sectional view showing the condition where the air direction control device of the blowing unit turns the air direction toward the back of a paper sheet in the embodiment of the invention.
Figure 6:
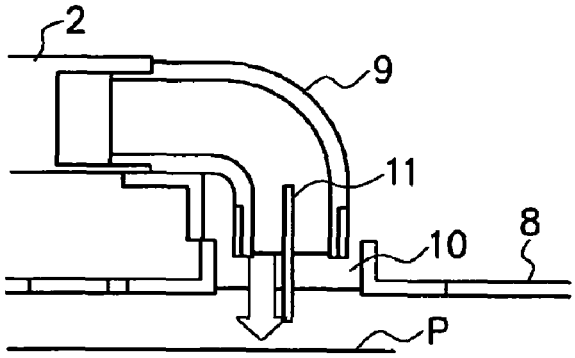
FIG. 6 is a sectional view showing the condition where the air direction control device of the blowing unit turns the air direction abeam in the embodiment of the invention.
Figure 7:
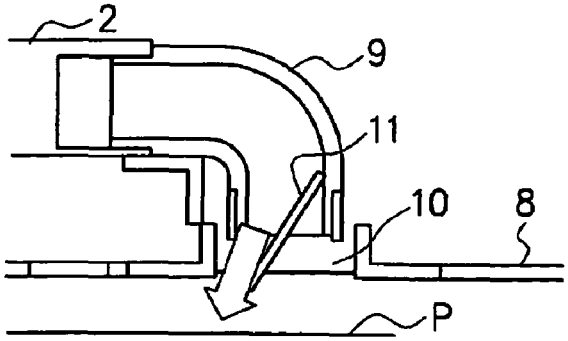
FIG. 7 is a sectional view showing the condition where the air direction control device of the blowing unit turns the air direction ahead of the paper sheet in the embodiment of the invention.

FIG. 5 to FIG. 7 are sectional views in a horizontal plane of the height at which the duct 9 and the air direction control plate 11 exist, the lateral direction in each drawing is the paper feeding direction, and the leading edge of the paper sheet P is on the left in each drawing. When the end edge on the side fence 8 side of the air direction control plate 11 is turned backward in the paper feeding direction (to the trailing edge side of the paper sheet P, to the right in the drawing) as shown in FIG. 5, the air from the duct 9 blows against the air direction control plate 11 to form an air current heading backward in the paper feeding direction inside the side fence 8. When the air direction control plate 11 is set right-angled to the side fence 8 as shown in FIG. 6, the air from the duct 9 travels parallel to the air direction control plate 11 and enters straight the side fence 8 in the direction orthogonal to the side fence 8 inside. When the end edge on the side fence 8 side of the air direction control plate 11 is turned forward in the paper feed direction (to the leading edge side of the paper sheet P, to the left in the drawing) as shown in FIG. 7, the air from the duct 9 blows against the air direction control plate 11 to form an air current heading forward in the paper feed direction inside the side fence 8.

Regarding the center line parallel to the carrying direction of the paper sheet P, that is, the longitudinal center line bisecting the width direction of the paper sheet P, it is possible to say that the blowing units 2 are provided right and left in a pair, but when the paper feeder 1 is seen from an angle of its installation state, it is possible to say that the units are provided on the front side (F side) and the rear side (R side) of the paper feeder 1 in a pair. This means that when the paper feeder 1 is seen on the whole, the paper feed table 3 is usually mounted on one side surface of the feeder body, the front side of the feeder corresponds to the right side, and the rear side of the feeder corresponds to the left side.

Generally in the paper feeder 1, when the paper sheet P is fed out in the paper feeding direction by the paper feeding unit 6, there is the possibility of causing troubles in paper feeding such as skewing, multi-feeding and idle feeding of the paper sheets P due to the mutual close contact state of the paper sheets P, unevenness of friction generated between the superposed paper sheets depending on places and other causes. In the paper feeder 1 according to the present embodiment, details to be mentioned later, as shown conceptually in FIG. 8, the air blow control part as a control unit controls the air quantity or air direction of the blowing units 2 according to the paper kind detection result and the above trouble detection result, so that the paper feeding condition can be improved to perform normal paper feeding.

As the trouble detecting unit, as shown in FIG. 2 and FIG. 3, transmission type paper detecting units 13 that make a pair are provided on the body side of an image forming apparatus on the downstream side of the paper feeding unit 6, thereby detecting the vicinities of both ends in the width direction of the paper sheet P. Regarding the center line in the width direction of the paper sheet P parallel to the carrying direction of the paper sheet P, it is possible to say that the transmission type paper detecting units 13 are provided right and left in a pair, but when the paper feeder 1 is seen from an angle of its installation state, it is possible to say that the units are provided on the front side (F side) and the rear side (R side) of the paper feeder 1 in a pair.

When the transmission type paper detecting units 13 detect the fed paper sheet P at the same time, the paper sheet P is determined to be fed normally, and when one of the units detects the paper sheet P earlier than the other, the paper sheet P is determined to skew. In that case, there is a difference in detection timing, and when the difference is smaller than a predetermined value, it is determined to be skewing. When the difference in detection timing is a value equal to or larger than the predetermined value, it is determined to be serious skewing. Further, when the transmission type paper detecting units 13 do not detect the paper sheet P in the preset timing of detecting the paper sheet P, it is determined to be idle feeding. Further, when the light received through the paper sheet P by the transmission type paper detecting units 13 is weaker than usual in the preset timing of detecting the paper sheet P, it is determined to be multi-feeding. How to control the air quantity and air direction of the blowing units 2 at the occurrence of these troubles will be mentioned later.

Figures 8, 9:
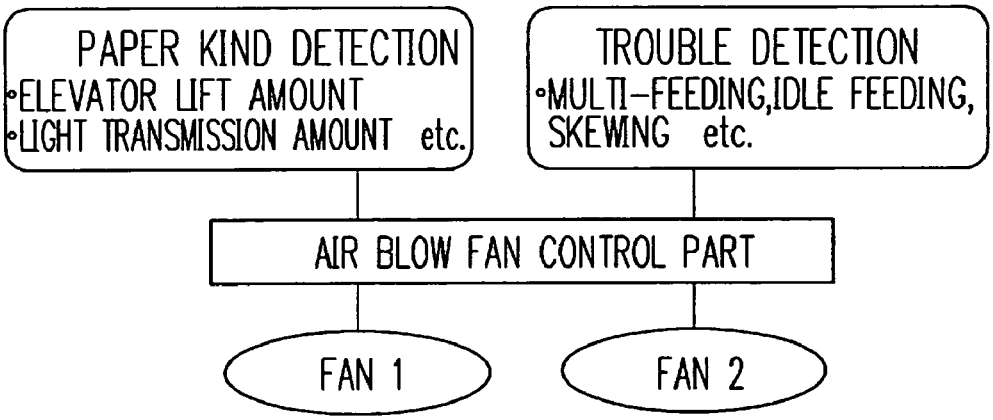
FIG. 8 is a diagram showing an air blow fan control part, which is a control part of the blowing unit in the embodiment as a control unit of the invention, and also the outline of control using the same.
FIG. 9 is a table showing settings of air quantity and air direction of the blowing unit corresponding to error information in the embodiment of the invention.

As the paper kind detecting unit, mode information and select paper information selected by a user's switching operation on a console panel (not shown) of the paper feeder 1 may be used, or as shown in FIG. 8, the lift amount (the elevator lift amount) of the paper feed table 3 caused by paper feeding may be measured by a position paper detecting unit not shown or thickness data on the paper sheet P may be measured by light transmission quantity of the transmission type paper detecting unit 13 to detect the kind of the paper sheet.

2. Adjustment for Air Quantity and Air Direction of Blowing Unit and Setting Range (FIG. 9 to FIG. 11)

It is considered that skewing of the paper sheet P is caused by a difference in sticking state or resistance cause such as coefficient of friction from a second paper sheet P located under the paper sheet concerned for some reason between the right side and the left side of the center line of the paper sheet P parallel to the paper feeding direction. As a result, even when the paper sheet P receives the carrying force parallel to the center line, it does not advance straight but moves obliquely.

It is considered that more of multi-feeding of the paper sheets P is caused by sticking state or resistance cause such as coefficient of friction between the uppermost paper sheet P and a second paper sheet P located under the paper sheet for some reason so that two paper sheets are united, and separated from the lower paper sheet P and fed out. It is considered that more of idle feeding of a paper sheet P is caused by sticking state or resistance cause such as coefficient of friction between the paper sheets P for some reason so that the paper sheets are not separated from each other and the paper feed roller runs idle to cause failure in carrying.

Then, in the paper feeder 1 in accordance with the embodiment, the air quantities of the blowing units 2, 2 can be controlled independently of each other, so that the air quantity of the blowing unit 2 on the larger resistance side is increased to accelerate separation of the paper sheet P on this side, and the state of the left and right sides of the paper sheet P is made as uniform as possible to cause the paper sheet P to travel parallel to the paper feeding direction. Thus, slight to serious skewing of the paper sheet P can be corrected.

Further, in the paper feeder 1 in accordance with the embodiment, the air directions of the blowing units 2, 2 are varied independently of each other as described above, so that when the air directions of the respective blowing units are made opposite to each other, a turning force in a desired direction is applied to the paper sheet P to further accelerate separation of the paper sheet P on the larger resistance side, and the state of the left and right sides of the paper sheet P is made as uniform as possible to cause the paper sheet P to travel parallel to the paper feeding direction. Thus, serious skewing of the paper sheet P can be corrected.

Further, in the paper feeder 1 in accordance with the embodiment, the air quantities of the blowing units 2, 2 are made larger than those in the case of slight skewing to cope with multi-feeding and idle feeding, which will cause a serious jam, similarly to the case of the serious skewing.

FIG. 9 shows the adjustable ranges for the air quantity and air direction of the blowing unit 2 in a table form, FIG. 10 is a table showing the adjustment range for the air quantity and air direction of the blowing unit 2, and FIG. 11 is a table showing settings of air quantity of the blowing unit 2 corresponding to paper information. In FIG. 9 to FIG. 11, the blowing unit F is the front (FRONT), that is, the right blowing unit 2, and the blowing unit R is the rear (REAR), that is, the left blowing unit 2.

As shown in FIG. 9, the air quantities of the respective blowing units 2 (F, R) can be preset in five levels from the minimum 1 to the maximum 5. As to the air direction, three ways, forward, transverse and backward can be preset. In the initial setting of the respective blowing units 2 (F, R), the air quantity is 1, and the air direction is transverse.

As shown in the columns of "multi-feeding" and "idle feeding" in FIG. 10, the air quantity and air direction of the respective blowing units 2 (F, R) are respectively set according to the kind of trouble. When multi-feeding and idle feeding are detected, the air quantity is increased from the initial setting to +2 in both of the blowing units 2 (F, R).

As shown in the column "skew (slight)" in FIG. 10, when the F side one of the transmission type paper detecting units 13 detects the paper sheet P earlier and a difference in detection timing between the F side and R side transmission type detecting units 13 is larger than 0 and smaller than a predetermined value (0<F−R<predetermined value), it is determined to be slight skewing in which the F side of the paper sheet P precedes. That is, a difference in detection timing between the transmission type paper detecting units 13 (F, R) is a predetermined time or less (this is not multi-feeding). In this case, the air quantity of the blowing unit 2 (F) is decreased from the initial setting to −1, and the air quantity of the blowing unit 2 (R) is increased from the initial setting to +1. On the other hand, when the R side of the transmission type paper detecting units 13 detects the paper sheet P earlier and a difference in detection timing between the R side and F side transmission type detecting units 13 is larger than 0 and smaller than a predetermined value (0<R−F<a predetermined value), it is determined to be slight skewing in which the R side of the paper sheet P precedes. In this case, the air quantity of the blowing unit 2 (F) is increased from the initial setting to +1, and the air quantity of the blowing unit 2 (R) is decreased from the initial setting to −1.

As shown in the upper part of a column "skew (serious)" in FIG. 10, when the F side of the transmission type paper detecting units 13 detects the paper sheet P earlier and a difference in detection timing between the F side and R side transmission type paper detecting units 13 exceeds a predetermined value (F−R>predetermined value), it is determined to be serious skewing in which the F side of the paper sheet P precedes. That is, the difference in detection timing between the transmission type paper detecting units 13 (F, R) is a predetermined time or more. In this case, the air quantity of the blowing unit 2 (F) is decreased from the initial setting to −2, and the air quantity of the blowing unit 2 (R) is increased from the initial setting to +2. Alternatively the air quantities of both the blowing units 2 (F, R) remain as initially set, and as typically shown in FIG. 19, the air direction of the blowing unit 2(F) is backward, the air direction of the blowing unit 2 (R) is forward, and a clockwise air current is generated between the paper sheet P and the paper sheet P to correct the paper sheet P inclined to the left so that the paper sheet P is guided to the right.

As shown in the lower side of the column "skew (serious)" in FIG. 10, when the R side of the transmission type paper detecting units 13 detects the paper sheet P earlier and a difference in detection timing between the R side and F side transmission type paper detecting units 13 exceeds a predetermined value (R−F>a predetermined value), it is determined to be serious skewing in which the R side of the paper sheet P precedes. In this case, the air quantity of the blowing unit 2 (F) is increased from the initial setting to +2, and the air quantity of the blowing unit 2 (R) is decreased from the initial setting to −2.

Figure 19:
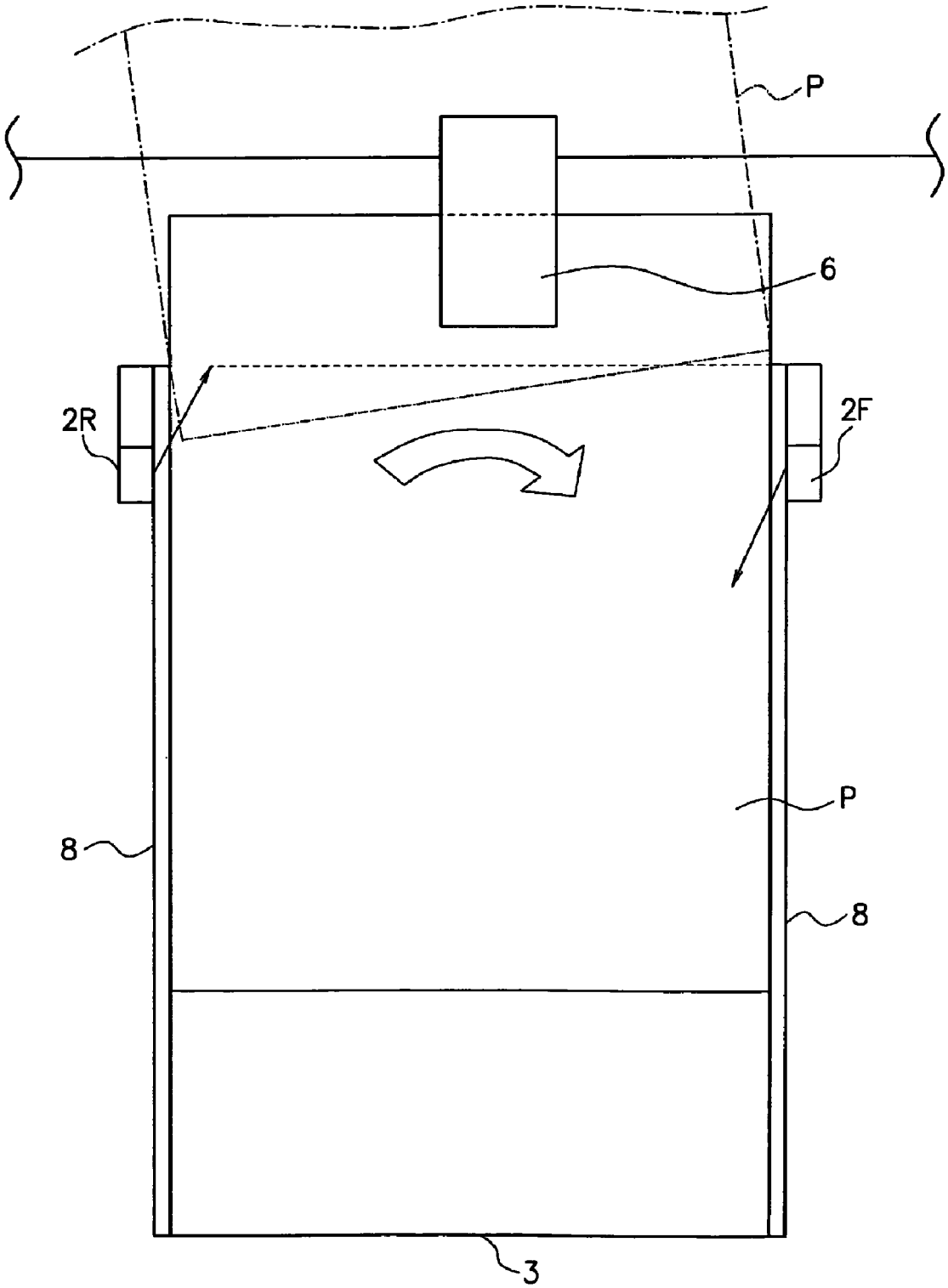
FIG. 19 is a conceptual drawing showing the situation where skewing of a paper sheet is corrected by the air direction control of the blowing units that make a pair in the embodiment of the invention.

Further, the air quantities of both the blowing units 2 (F, R) remain as initially set, and although an example typically shown in FIG. 19 is reversed from right to left, the air direction of the blowing unit 2(F) is forward, the air direction of the blowing unit 2 (R) is backward, and a counter-clockwise air current is generated between the paper sheet P and the paper sheet P to correct the paper sheet P inclined to the right so that the paper sheet P is guided to the left.

As shown in FIG. 11, in the case of lightweight paper, both of the blowing units 2 (F, R) are set to +2 from the initial setting. In the case of heavy paper, no change is made from the initial setting.

The described information shown in FIG. 9 to FIG. 11 is provided as control information prepared in advance in the state of being stored in a memory or the like in a control unit or the like (including an air blow fan control part shown in FIG. 8) of the paper feeder 1 or an image forming apparatus to which the paper feeder 1 is attached, and may be suitably rewritten corresponding to the control status containing the state of trouble occurrence and an increase in number of kinds of paper sheets P used.

3. Occurrence of Error and Correction Method in Operating State (FIG. 12 to FIG. 19)

Figure 12:
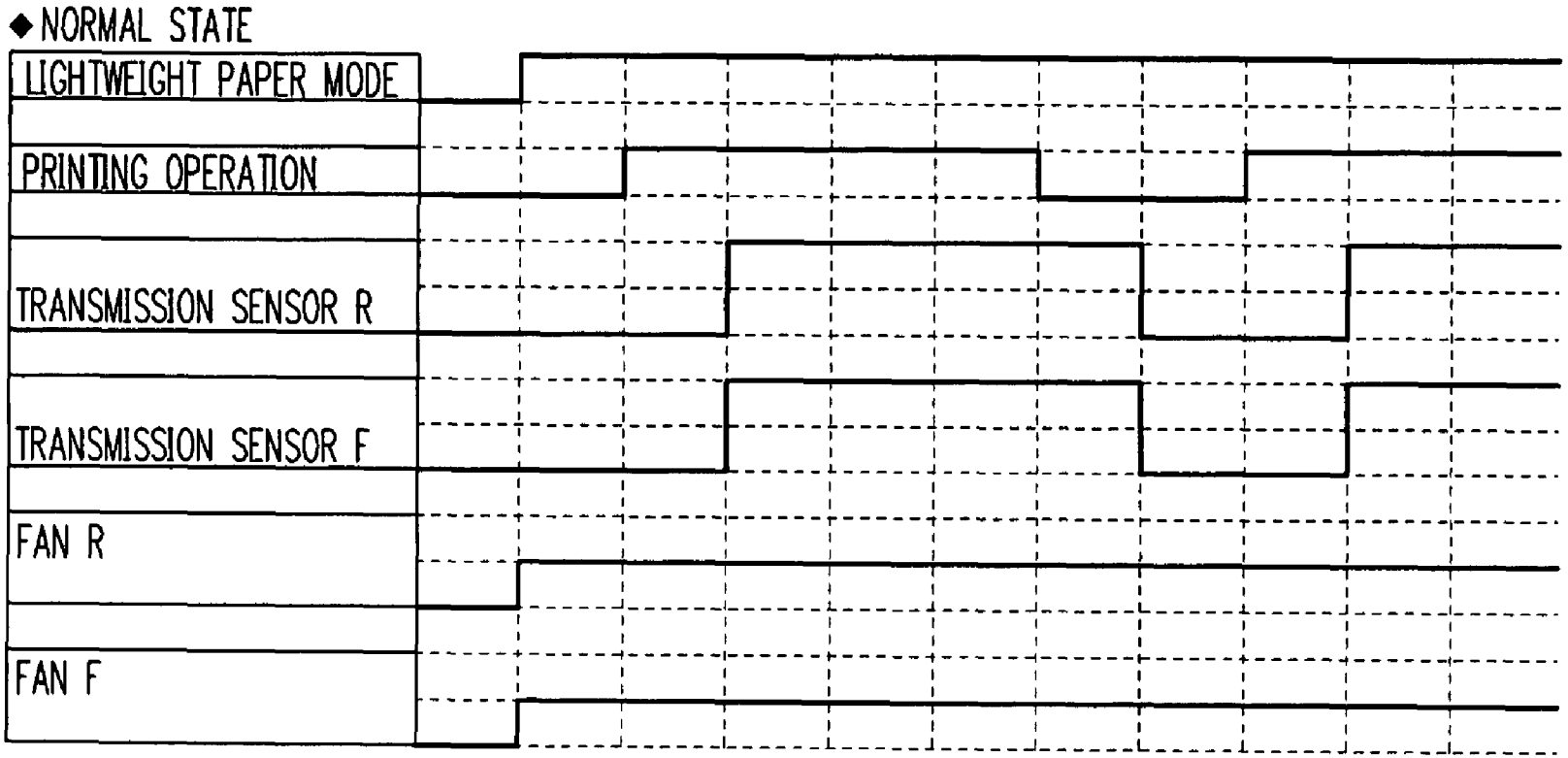
FIG. 12 is a driving timing chart in the normal state in the embodiment of the invention.

FIG. 12 is a driving timing chart in the normal state. When a lightweight paper mode is set, the blowing units 2 (F, R) start blowing the air at initial setting of the air quantity 1 and in the transverse air direction. When the printing operation starts, a printed paper sheet P fed out normally reaches the transmission type paper detecting units 13 (F, R) in the same timing (the respective paper detecting units: ON, light receiving level: 2) and pass through the transmission type paper detecting units 13 (F, R) in the same timing (the respective paper detecting units: OFF). The lightweight paper mode in the present embodiment is a mode of supplying and printing the lightweight paper sheets, which are liable to stick to each other to easily cause skewing, multi-feeding and idle feeding. This mode is also a mode of conducting the blowing unit control to cope with troubles in carrying the paper sheets according to the present embodiment.

Figure 13:
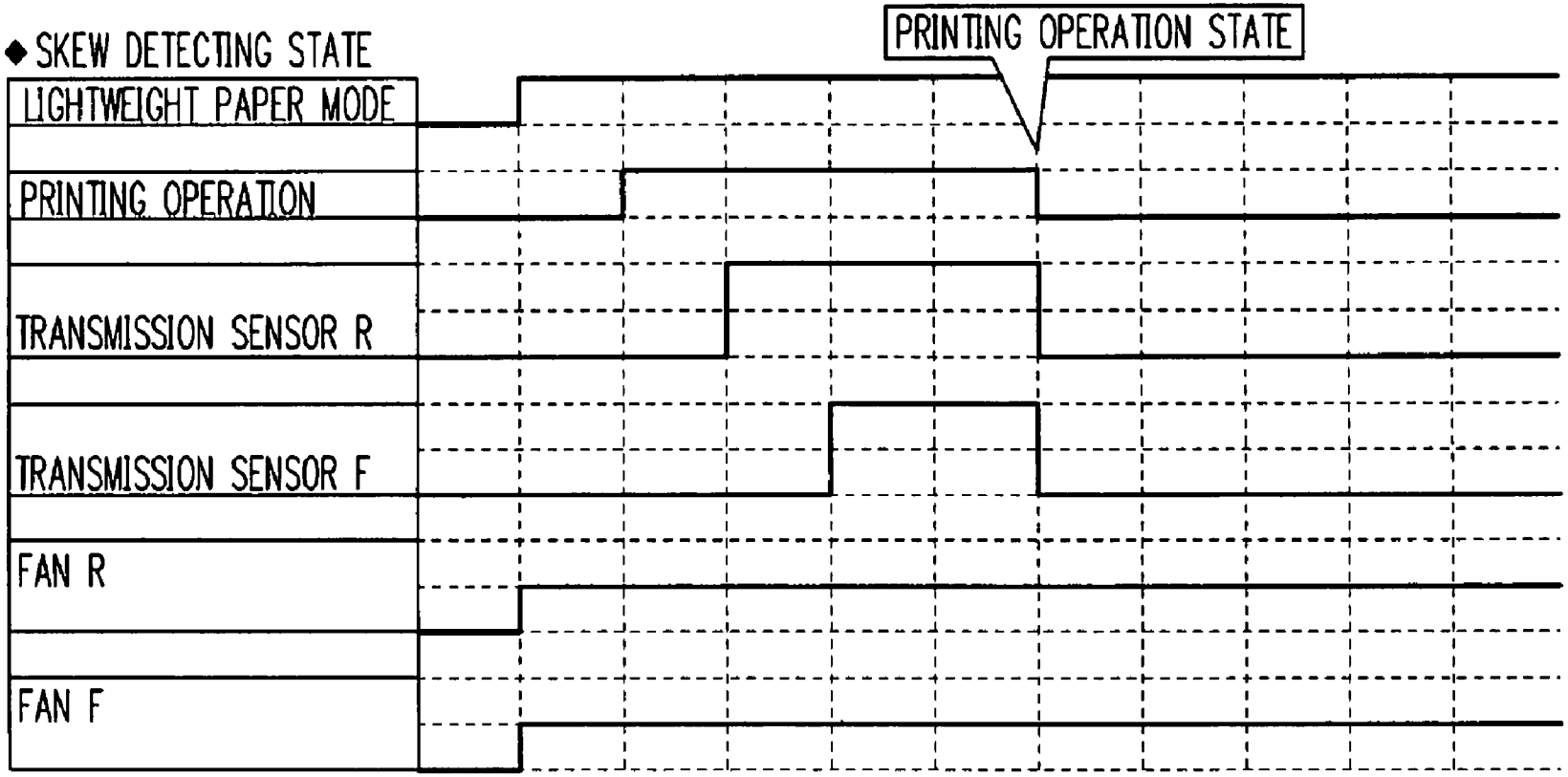
FIG. 13 is a driving timing chart in the case of making no correction when skewing is detected in the embodiment of the invention.

FIG. 13 is a driving timing chart in the case of making no correction when skewing is detected. When the lightweight paper mode is set, the blowing units 2 (F, R) start blowing the air at initial setting of the air quantity 1 and in the transverse air direction. When the printing operation starts and a paper sheet P is skewed to drop behind on the F side and fed out, although the paper sheet reaches the R side of the transmission type paper detecting units 13 in the normal timing (the paper detecting units: ON, the light receiving level: 2), the paper sheet reaches the F side in the lagged timing. Thus, skewing is detected. When a jam occurs due to skewing, basically the operation is stopped as illustrated to clear the jam, and as shown in the table in FIG. 10, the air quantities and the like of the respective blowing units 2 (F, R) are set to cope with skewing to be ready for the next operation. In the case of slight skewing, however, while the air quantities or the like of the respective blowing units 2 (F, R) are set to cope with skewing, the operation may be continued.

Figure 14:
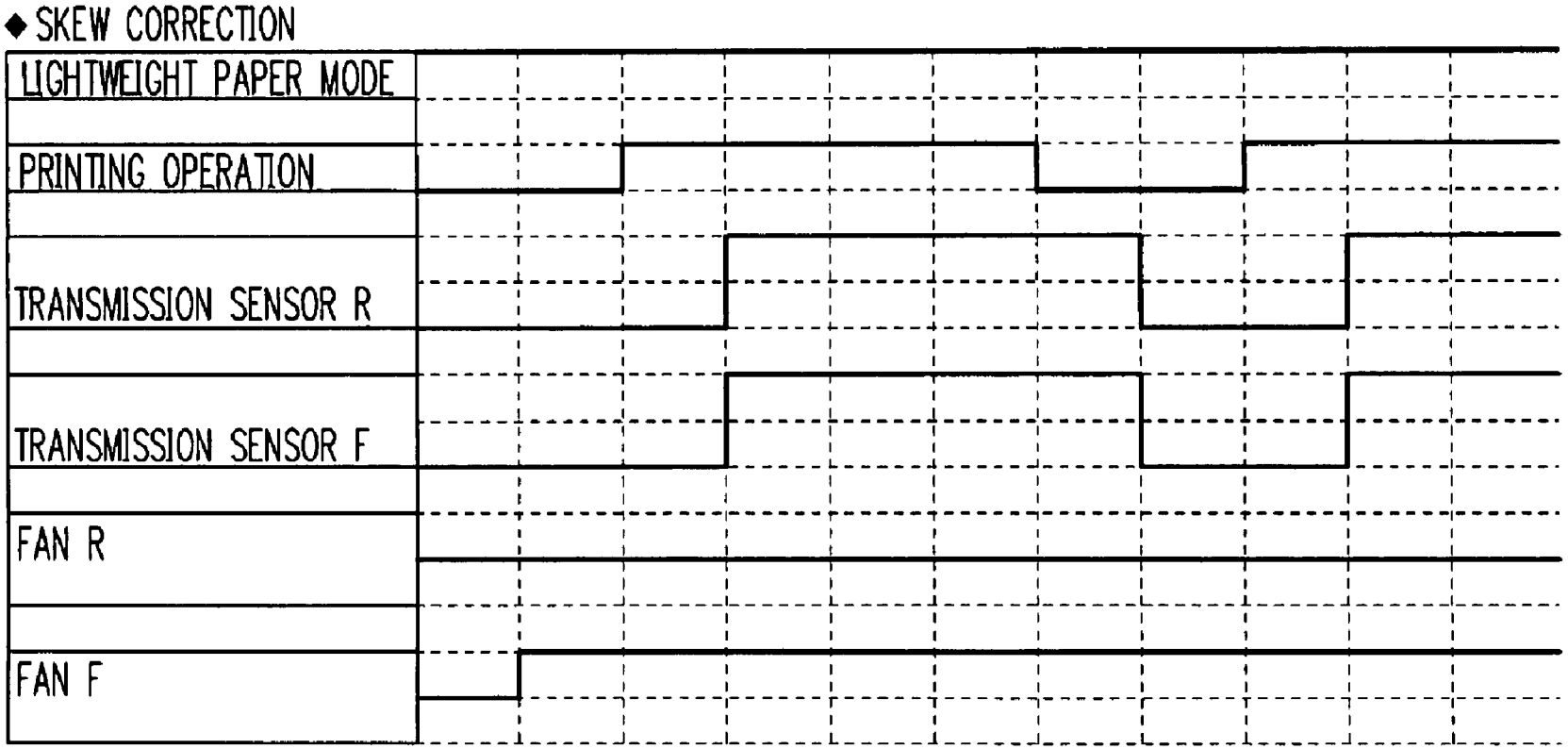
FIG. 14 is a driving timing chart when skewing is corrected in the embodiment of the invention.

FIG. 14 is a driving timing chart when skewing is corrected. When the lightweight paper mode is set, the R side of the blowing units 2 (F, R) starts blowing the air at initial setting of the air quantity 1 and in the transverse air direction, but the F side of the blowing units 2 starts blowing the air when being increased in air quantity of the air quantity 2, which is larger than the initially set air quantity by one level and in the transverse air direction. When the printing operation starts, a paper sheet P is normally fed out without skewing in different air quantities of the right and left blowing units 2, so that the paper sheet can reach the transmission type paper detecting units 13 (F, R) of the same timing (the respective paper detecting units: ON, the light receiving level: 2), and pass through the transmission type paper detecting units 13 (F, R) at the same timing (the respective paper detecting units: OFF).

Figure 15:
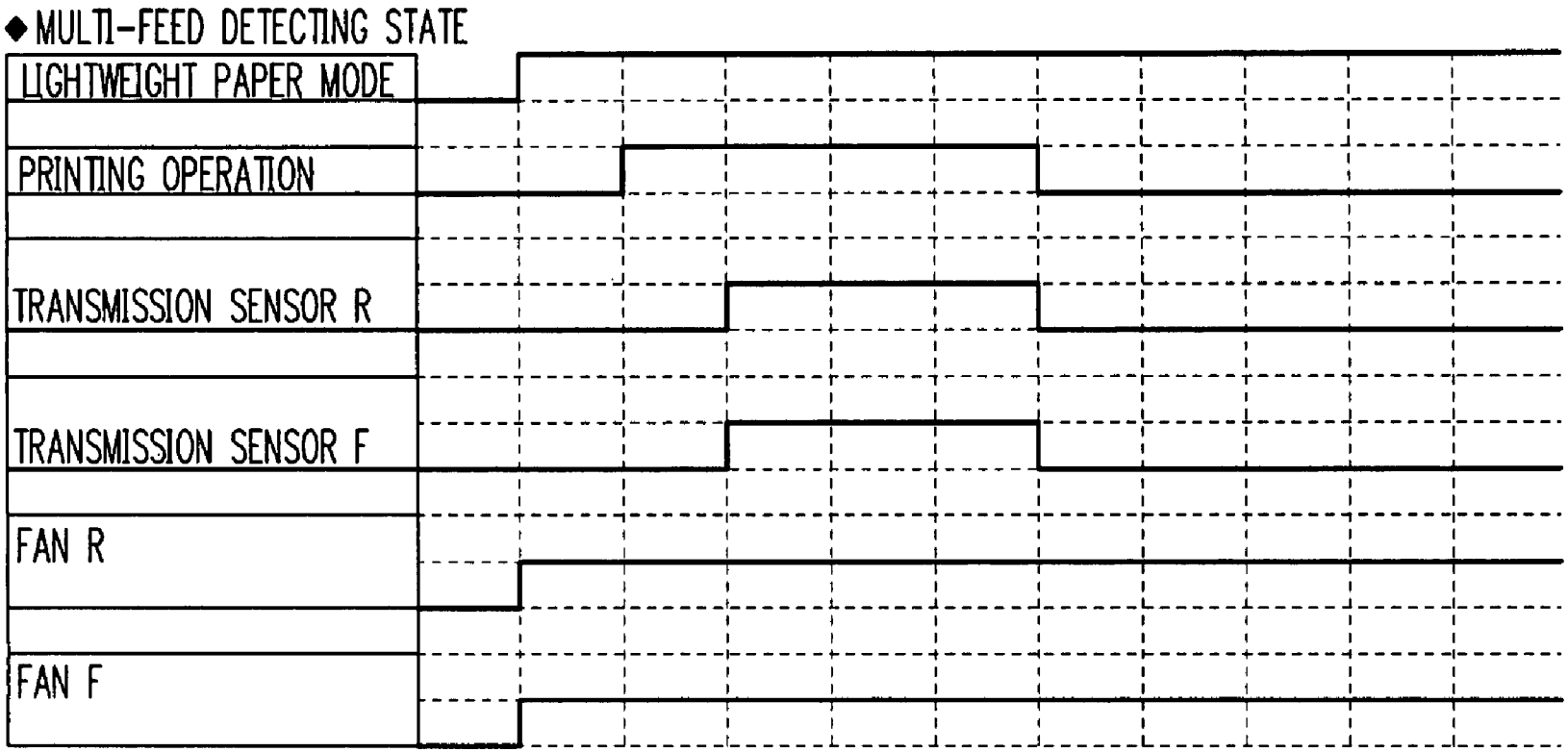
FIG. 15 is a driving timing chart in the case of making no correction when multi-feeding is detected in the embodiment of the invention.

FIG. 15 is a driving timing chart in the case of making no correction when multi-feeding is detected. When the lightweight paper mode is set, the blowing units 2 (F, R) start blowing the air at initial setting of the air quantity 1 and in the transverse air direction. The printing operation starts, and two or more stacked paper sheets P reach the transmission type paper detecting units 13 (F, R) at the same time. In this case, although skewing does not occur, the light receiving level is 1 at both of the paper detecting units. This is smaller than in the normal state, so multi-feeding of stacked paper sheets P is detected. When a jam occurs due to multi-feeding, basically the operation is stopped and the jam is cleared as illustrated, and as shown in the table in FIG. 10, the air quantities or the like of the respective blowing units 2 (F, R) are set to cope with multi-feeding to be ready for the next operation.

Figure 16:
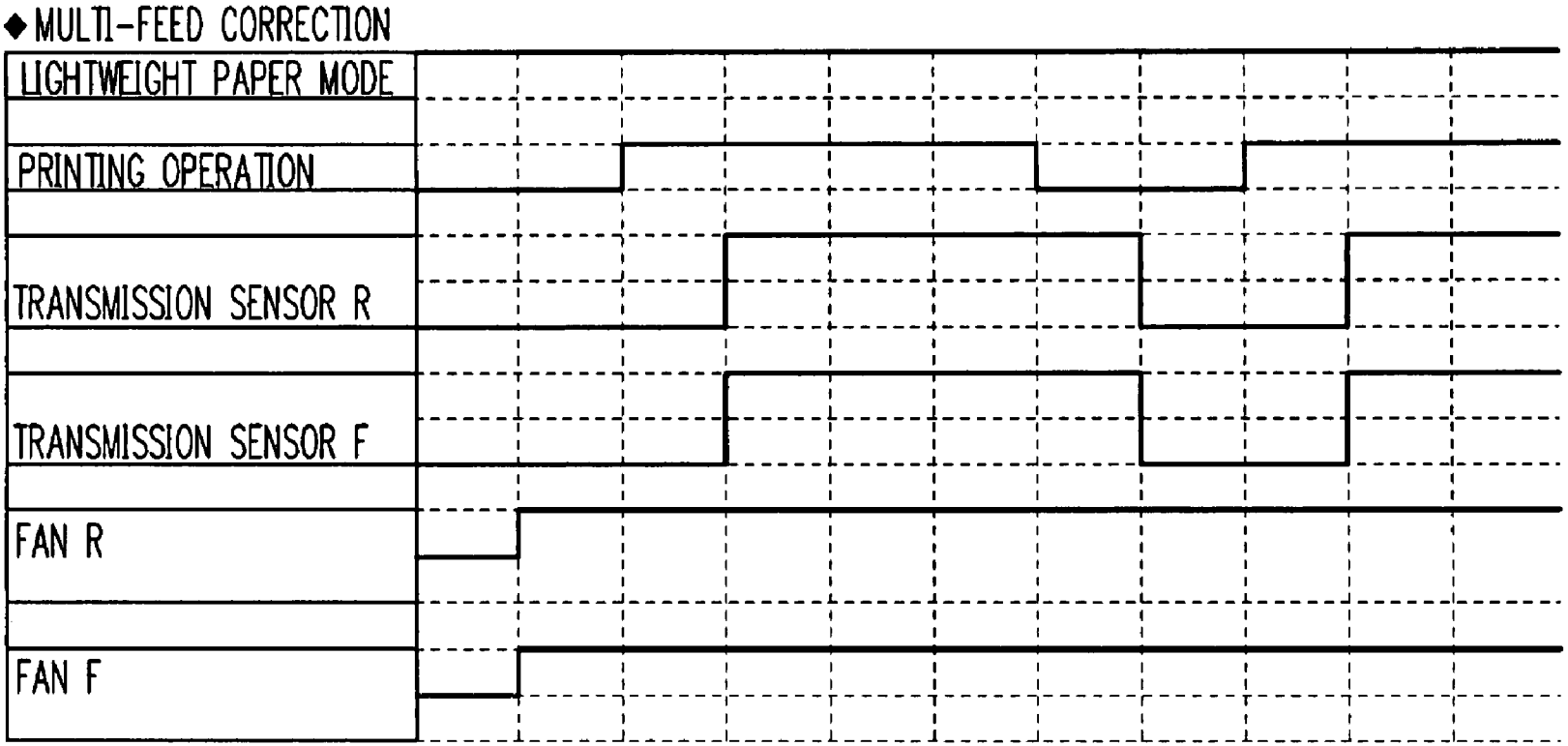
FIG. 16 is a driving timing chart when multi-feeding is corrected.

FIG. 16 is a driving timing chart when multi-feeding is corrected. When the lightweight mode is set, the R side and the F side of the blowing units 2 (F, R) both start blowing the air at the increased air quantity of air quantity 2, which is larger than the initially set air quantity by one level and in the transverse air direction. When the printing operation starts, a paper sheet P is surely separated from the other paper sheets with the air quantities of the right and left blowing units 2 larger than usually so that the paper sheets can be normally fed out one by one without multi-feeding, and detected in the same timing by the transmission type paper detecting units 13 (F, R) and also at the normal light receiving level 2.

Figure 17:
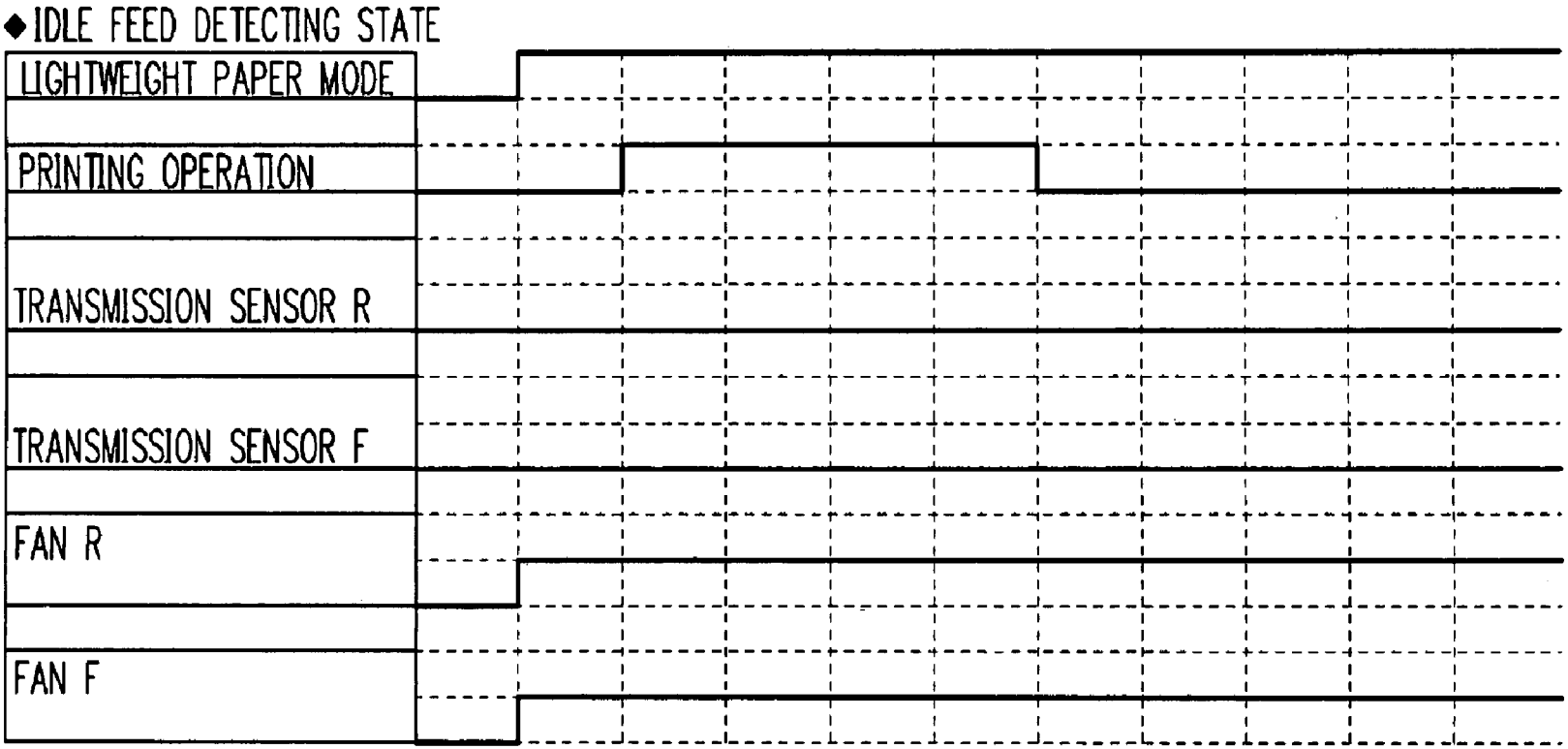
FIG. 17 is a driving timing chart in the case of making no correction when idle feeding is detected.

FIG. 17 is a driving timing chart in the case of making no correction when idle feeding is detected. When the lightweight paper mode is set, the blowing units 2 (F, R) start blowing the air at initial setting of the air quantity 1 and in the transverse air direction. When the printing operation starts and it enters idle feeding state where no paper feeds out, neither of the transmission type paper detecting units (R, F) detects a paper sheet P at the preset timing of detecting the paper sheet P. Thus, idle feeding, in which no paper sheet P is fed out, is detected. In the case of idle feeding, basically the operation is stopped as illustrated, and after that, as shown in the table in FIG. 10, the air quantities or the like of the respective blowing units 2 (F, R) are set to cope with idle feeding to be ready for the next operation.

Figure 18:
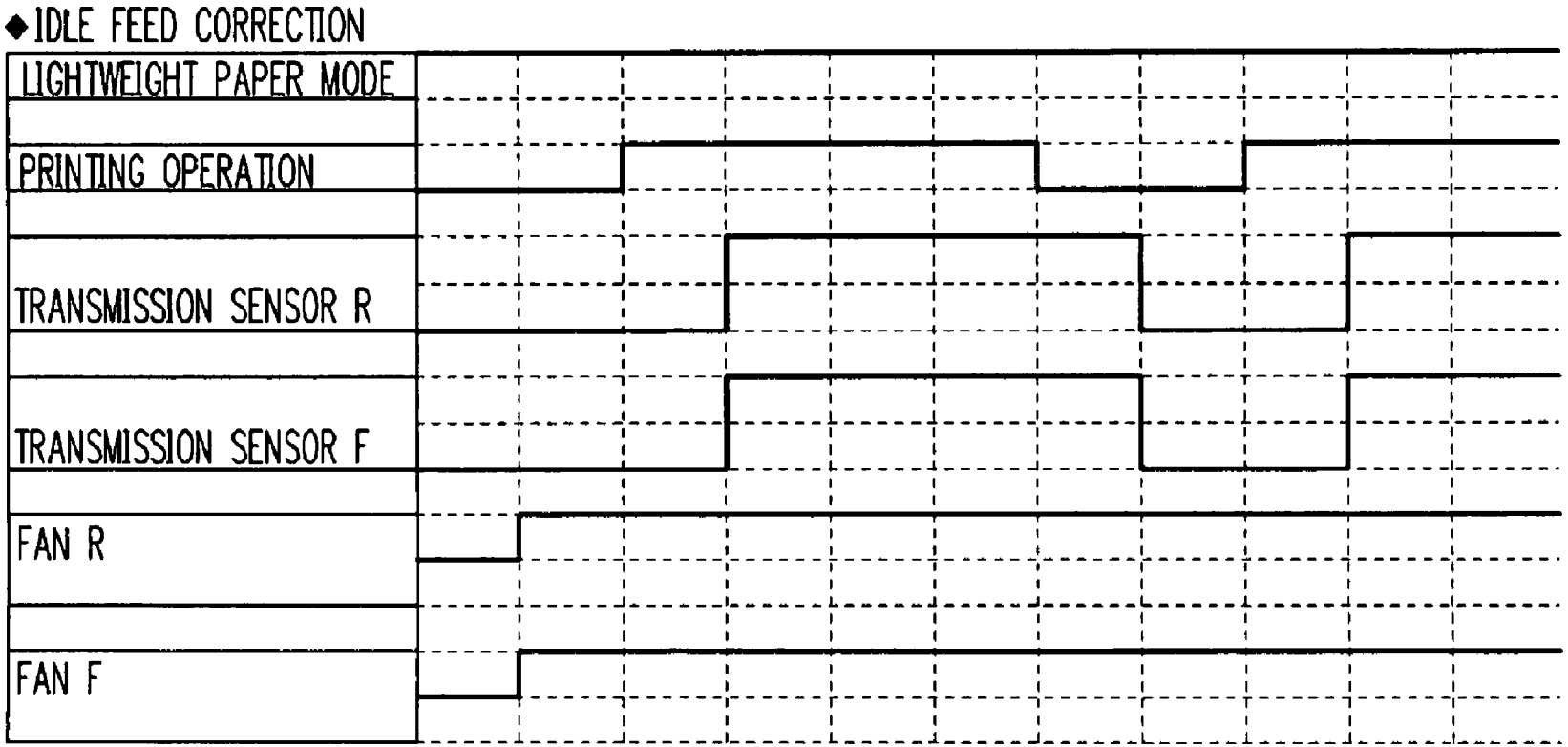
FIG. 18 is a driving timing chart when idle feeding is corrected in the embodiment of the invention.

FIG. 18 is a driving timing chart when idle feeding is corrected. When the lightweight paper mode is set, the R side and the F side of the blowing units 2 (F, R) both start blowing the air at initial setting of the air quantity 2 and in the transverse air direction, the air quantity 2 being larger than the initially set air quantity 1 by one level. When the printing operation starts, a paper sheet P is surely separated from the other paper sheets with the air quantities of the blowing units 2 (F, R) larger than usually so that the paper sheets can be normally fed out one by one without idle feeding, and detected at the same timing by the transmission type paper detecting units 13 (F, R) and also at the normal light receiving level 2.

Figure 20:
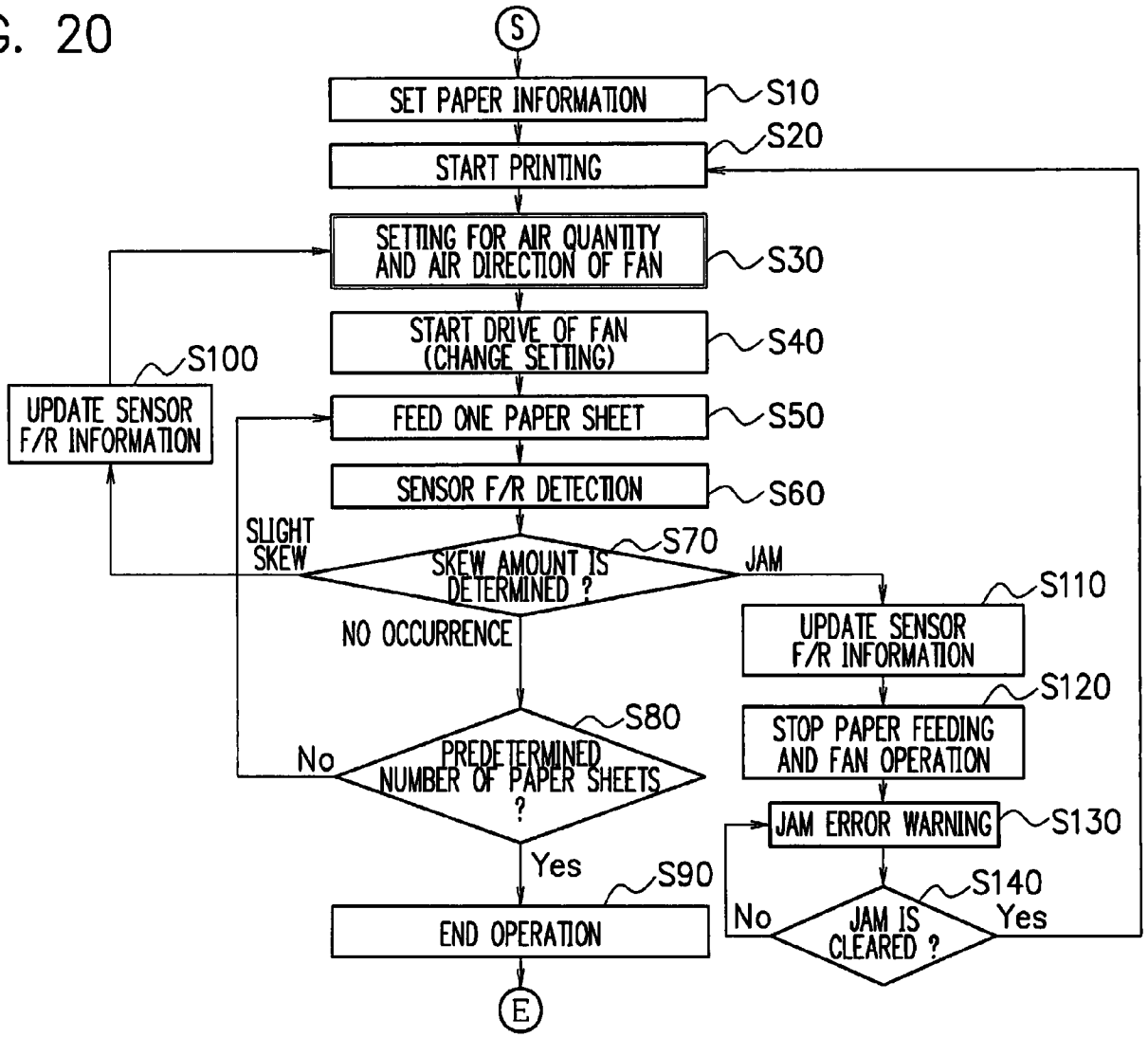
FIG. 20 is a flowchart showing the control procedure in the embodiment of the invention.

4. General Control Procedure (FIG. 20)

Although the above description deals with the adjustment method for the air quantity and the air direction of the blowing units 2 corresponding to the classification of carrying failure with reference to FIG. 9 to FIG. 19, in the following, the general procedure of the operation performed by a control unit (an air blow fan control part) in the image forming apparatus including the paper feeder 1 will be described with reference to FIG. 20 on the basis of the above description.

In the S10 (this means a step 10, and so forth), a user sets paper information such as classification, lightweight paper or heavy paper from a console panel not shown. The paper information, as described above, may be mode information selected on the console panel by the user. Or the kind of the paper sheet may be detected to set the paper information according to the setting information of the paper feed part or a signal of the light transmission quantity from the transmission type paper detecting units 13.

In the S20, the user starts printing. In the S30, according to the preset paper information and an output signal from the transmission type paper detecting units 13 (F, R), the air quantity and the air direction of the blowing units 2 (F, R) are set based on the information stored in the memory as shown in FIG. 10 and FIG. 11. In the S40, the blowing units 2 (F, R) start driving. When the air quantity or the like is set in the S30, the setting is changed here and the drive is started. In the S50, the paper feed part feeds out one paper sheet P. In the S60, the transmission type paper detecting units 13 (F, R) detect the paper sheet P concerned which has been printed in the printing part and transported.

In the S70, skewing (slight or serious) is detected as shown in FIG. 10 according to whether or not there is a difference in detection timing for the paper sheet P between the transmission type paper detecting units 13 (F, R), and whether the timing difference is larger or smaller than a predetermined value as a criterion. As shown in FIG. 10, it is detected whether or not multi-feeding or idle feeding occurs according to the light receiving levels of the transmission type paper detecting units 13 (F, R). It is determined whether or not a jam occurs according to the decision on whether or not such trouble in carrying occurs.

As a result of determining the skew amount in the S70, when it is determined that skewing does not occur and the occurrence of a jam is not found ("no jam" in the S70), the operation is ended in the S90 on determining that printing for a designated number of paper sheets is ended in the S80 (YES, in the S70). When it is determined that printing for the designated number of paper sheets is not ended (NO, in the S70), the procedure returns to the S50 to restart the printing operation beginning with feeding one paper sheet.

When it is determined that slight skewing, which will not cause a jam, occurs ("slight skew" in the S70) in the S70, corresponding information of the memory in the control unit is updated with the information acquired by the transmission type paper detecting units 13 (F, R) in the S100, and the air quantity and air direction of each blowing unit 2 (F, R) are set based on the information updated in the S30.

As a result of skew amount determination in the S70, when it is determined that skewing occurs and a jam occurs ("jam" in the S70), that is, when serious skewing, which will cause a jam, multi-feeding or idle feeding is detected, the corresponding information of the memory in the control unit is updated based on the information acquired by the transmission type paper detecting units 13 (F, R) in the S110. In the S120, the paper feeding operation and the blowing operation of the blowing units 2 (F, R) are stopped, and in the S130, a jam error warning is displayed on a display unit not shown. When the jam is cleared (YES, in the S140), the procedure returns to the S20 to again start printing. When the jam is not cleared (NO, in the S140), the jam error warning is continuously or repeatedly displayed on the display unit (S130).

In the described embodiment, the pair of blowing units 2, 2 (or two pairs of blowing units) are provided on the F side (front side) and the R side (rear side) in the paper feeder 1. In other words, the units are provided close to the left side edge and the right side edge of the paper sheet P with respect to the center line in the width direction of the paper sheet P. However, the blowing units 2, 2 can be controlled independently of each other at least in air quantity, and also it will be sufficient that the units are located to blow the air to the paper sheet P from the symmetrical positions. For example, right and left units may be provided close to the leading end of the paper sheet P, not limited to the right and left side edges.

Although the air directions of the blowing units 2, 2 are changed to prevent serious skewing in the embodiment, it is not necessary that setting of the air direction is limited especially to the embodiment as long as stronger air is blown against an area of the paper sheet P where sticking or increase in friction is occurring, or rotation is given to the paper sheet P so that the area concerned easily separates.

Further, the present embodiment shows two methods for correcting serious skewing, one in which the air quantity of the blowing units 2, 2 is increased and one in which different air directions are set. Especially in the case of serious skewing, both of these methods may be combined for use. Similarly, in order to cope with multi-feeding and idle feeding which will cause a serious jam, a method of setting different air directions may be used alone, or together with the method of increasing the air quantity.

A list is given below of reference letters and numerals of the components in the present embodiment used in reference to the drawings of the specification.

1. Paper feeder
2. Blowing unit (F, R)
3. Paper feed table
6. Paper feeding unit
8. Side fence
11. Air direction control plate
13. Transmission type paper detecting unit (F, R)
P. Paper sheet

What is claimed is:

1. A paper feeder, comprising:
a paper feed table on which paper sheets are stacked;
a paper feed roller, which is provided at a predetermined position above the paper feed table and driven in contact with an upper surface of an uppermost paper sheet of the paper sheets stacked on the paper feed table to feed the uppermost paper sheet in a paper feeding direction;
a pair of paper detecting units, which is provided on a downstream side in the paper feeding direction with respect to the paper feed roller to respectively detect two end parts in a paper width direction of the paper sheet fed in the paper feeding direction;
a pair of blowing units, which is provided along the paper width direction; and
a control part controlling the pair of blowing units independently so that the pair of blowing units is controlled to be different in air quantity based on a difference in paper detection timing between the pair of paper detecting units to blow air below the uppermost paper sheet.

2. The paper feeder according to claim 1, further comprising: a transmission paper detecting unit provided on the downstream side of the paper feed roller as the paper detecting unit, wherein the air quantity of the pair of blowing units is increased based on a light receiving quantity of the transmission paper detecting unit to control at least one of paper multi-feeding and idle feeding to be corrected.

3. A paper feeder, comprising:
a paper feed table on which paper sheets are stacked;
a paper feed roller, which is provided at a predetermined position above the paper feed table and driven in contact with an upper surface of an uppermost paper sheet of the paper sheets stacked on the paper feed table to feed the uppermost paper sheet in a paper feeding direction;

a pair of paper detecting units, which is provided on a downstream side in the paper feeding direction with respect to the paper feed roller to respectively detect two end parts in a paper width direction of the paper sheet fed in the paper feeding direction;

a pair of blowing units, which is provided along the paper width direction; and a control part controlling the pair of blowing units independently so that the pair of blowing units is controlled to be different in air direction based on a difference in paper detection timing between the pair of paper detecting units to blow air below the uppermost paper sheet to thereby correct skewing of the fed-out paper sheet.

* * * * *